US006074173A

United States Patent [19]

Taguchi

[11] Patent Number: 6,074,173

[45] Date of Patent: Jun. 13, 2000

[54] VARIABLE DISPLACEMENT COMPRESSOR IN WHICH A LIQUID REFRIGERANT CAN BE PREVENTED FROM FLOWING INTO A CRANK CHAMBER

[75] Inventor: Yukihiko Taguchi, Maebashi, Japan

[73] Assignee: Sanden Corporation, Gunma, Japan

[21] Appl. No.: 09/141,375

[22] Filed: Aug. 27, 1998

[30] Foreign Application Priority Data

Sep. 5, 1997 [JP] Japan ..... 9-240981

[51] Int. Cl.[7] ..... F04B 1/26

[52] U.S. Cl. ..... 417/222.2; 417/270

[58] Field of Search ..... 417/222.2, 270

[56] References Cited

U.S. PATENT DOCUMENTS

| | | | |
|---|---|---|---|
| 4,586,874 | 5/1986 | Hiraga et al. | 417/222 |
| 4,702,677 | 10/1987 | Takenaka et al. . | |
| 4,723,891 | 2/1988 | Takenaka et al. . | |
| 4,730,986 | 3/1988 | Kayukawa et al. . | |
| 4,747,753 | 5/1988 | Taguchi | 417/222 |
| 4,778,348 | 10/1988 | Kikuchi et al. | 417/222 |
| 4,780,059 | 10/1988 | Taguchi | 417/222 |
| 4,780,060 | 10/1988 | Terauchi | 417/222 |
| 4,842,488 | 6/1989 | Terauchi | 417/222 |
| 4,874,295 | 10/1989 | Kobayashi et al. | 417/222 |
| 4,878,817 | 11/1989 | Kikuchi et al. | 417/222 |
| 4,940,393 | 7/1990 | Taguchi | 417/222 |
| 4,960,367 | 10/1990 | Terauchi | 417/222 |
| 5,080,561 | 1/1992 | Taguchi | 417/222 |
| 5,092,741 | 3/1992 | Taguchi | 417/222 |
| 5,286,172 | 2/1994 | Taguchi | 417/222 |
| 5,586,874 | 12/1996 | Hashimoto et al. | 417/569 |

FOREIGN PATENT DOCUMENTS

| | | |
|---|---|---|
| 0219283 | 10/1986 | European Pat. Off. . |
| 283963 | 3/1988 | European Pat. Off. . |
| 0855506 | 7/1998 | European Pat. Off. . |
| 3824752 | 1/1990 | Germany . |
| 474549 | 11/1992 | Japan . |

*Primary Examiner*—Teresa Walberg
*Assistant Examiner*—Vinod D Patel
*Attorney, Agent, or Firm*—Baker Botts L.L.P.

[57] ABSTRACT

A variable displacement compressor controls a discharge displacement by changing an inclination of a swash plate (5) depending on a pressure differential between a crank chamber (3) and a suction chamber (13) thereby to change a piston stroke. A first communication passage (18) establishes communication between a discharge chamber (14) and the crank chamber. A pressure control valve (19) opens and closes the first communication passage. On the other hand, a second communication passage (20) establishes communication between the crank chamber and the suction chamber. A valve member (21) is disposed in the second communication passage and fully closes the second communication passage due to a biasing force of a spring when a pressure differential between the discharge chamber and the suction chamber becomes not greater than a given value.

12 Claims, 4 Drawing Sheets

VARIABLE DISPLACEMENT COMPRESSOR IN WHICH A LIQUID REFRIGERANT CAN BE PREVENTED FROM FLOWING INTO A CRANK CHAMBER

BACKGROUND OF THE INVENTION

The present invention relates to a variable displacement compressor for use in, for example, a vehicle air conditioner.

In general, variable displacement compressors are used in vehicle air conditioners. One of the compressors of this type is described in, for example, Japanese Second (examined) Patent Publication No. 4-74549.

The disclosed compressor is so-called a wobble plate type variable displacement compressor. The compressor has a compressor casing defining a crank chamber therein. A rotor is disposed in the crank chamber and mounted on a main shaft. A swash plate is attached to the rotor via a hinge mechanism. The main shaft passes through the swash plate. Specifically, a sleeve is attached to the swash plate and receives the main shaft therethrough. A space is formed between an outer periphery of the sleeve and an inner periphery of the swash plate so that an inclination of the swash plate relative to the main shaft can be changed by means of the hinge mechanism.

A wobble plate is attached to the swash plate via a bearing. A plurality of piston rods are coupled to the wobble plate through ball connection. The compressor casing is formed with a plurality of cylinders which are arranged at regular intervals so as to surround the main shaft. Each of the piston rods is coupled through ball connection to corresponding one of pistons disposed in the respective cylinders. In the crank chamber, a guide rod is supported by the compressor casing so as to extend in parallel to the main shaft. The guide rod is sandwiched by an end portion of the wobble plate so that the end portion of the wobble plate is wobbling relative to the guide rod in an axial direction of the main shaft.

Following the rotation of the main shaft, the rotation of the rotor is transmitted to the swash plate so that the wobble plate wobbles to cause the pistons to make reciprocating motions. In this fashion, the compressing operation is carried out. As described above, since the inclination of the swash plate relative to the main shaft is changeable by means of the hinge mechanism, the piston stroke can be changed by controlling the inclination of the swash plate, thereby to change the compression displacement of the compressor.

The foregoing variable displacement compressor has a suction chamber, a discharge chamber, a first communication passage extending from the discharge chamber to the crank chamber, an open/close valve for opening and closing the first communication passage, and a second communication passage or a bleed passage extending from the crank chamber to the suction chamber for constantly allowing discharge gas having flowed into the crank chamber through the first communication passage to escape into the suction chamber.

In the conventional variable displacement compressor of the wobble plate type, the crank chamber and the suction chamber are in constant communication with each other through the bleed passage. Thus, for example, if a liquid refrigerant exists at the low pressure side of a refrigerant circuit while the compressor is stopped for hours, the liquid refrigerant flows into the crank chamber via the suction chamber and through the bleed passage. Particularly, when a temperature in a vehicle compartment is relatively high while a temperature in an engine room where the compressor is installed is relatively low, a large amount of the liquid refrigerant flows into the crank chamber via the suction chamber.

When the compressor is started in this state, a pressure differential is generated across the bleed passage. This is because an open area of the bleed passage becomes insufficient relative to the amount of the liquid refrigerant in the crank chamber. So that, the inclination of the swash plate is held at the minimum compression displacement. As a result, until the liquid refrigerant is sufficiently removed from the crank chamber, the required cooling power can not be obtained.

SUMMARY OF THE INVENTION

It is therefore an object of the present invention to provide a variable displacement compressor which can ensure the required cooling power at the start-up of the compressor.

It is another object of the present invention to provide a variable displacement compressor of the type described, in which the liquid refrigerant can be prevented from storing in a crank chamber even if the compressor is stopped for hours.

Other objects of the present invention will become clear as the description proceeds.

A compressor to which an aspect of the present invention is applicable is for a fluid and comprises a compressor housing defining therein a crank chamber, a discharge chamber, and a suction chamber. The compressor further comprises a main shaft rotatably supported to the compressor housing and a swash plate disposed in the crank chamber and held to the main shaft to rotate together with the main shaft. The swash plate has an inclination variable relative to the main shaft. The compressor further comprises a piston responsive to a rotation of the swash plate for moving the fluid from the suction chamber to the discharge chamber with a variable displacement dependent on the inclination. The piston controls the inclination in response to a first pressure differential between the crank chamber and the suction chamber. The compressor further comprises a first communication passage connected between the discharge chamber and the crank chamber for permitting the fluid to move between the discharge chamber and the crank chamber through the first communication passage, a first valve coupled to the first communication passage for controlling the movement of the fluid through the first communication passage, a second communication passage connected between the crank chamber and the suction chamber for permitting the fluid to move between the crank chamber and the suction chamber through the second communication passage, and a second valve coupled to the second communication passage for controlling the movement of the fluid through the second communication passage.

A compressor to which another aspect of the present invention is applicable includes a compressor housing defining therein a crank chamber, a discharge chamber, and a suction chamber, and includes a swash plate disposed in the crank chamber and having a variable inclination relative to a main shaft. The swash plate is rotated in response to rotation of the main shaft to cause pistons to make reciprocating motions. The inclination of the swash plate is changed depending on a pressure differential between the crank chamber and the suction chamber to change a piston stroke so as to control a discharge displacement of the compressor. The compressor further comprises a first communication passage for establishing communication between the discharge chamber and the crank chamber, a valve coupled to the first communication passage for opening and closing the first communication passage to control a pressure in the crank chamber, a second communication passage for establishing communication between the crank chamber and the suction chamber, and a valve coupled to the second communication passage for fully closing the second communication passage when a pressure differential between the discharge chamber and the suction chamber becomes not greater than a predetermined value.

DESCRIPTION OF THE PREFERRED EMBODIMENT

Figure 1:
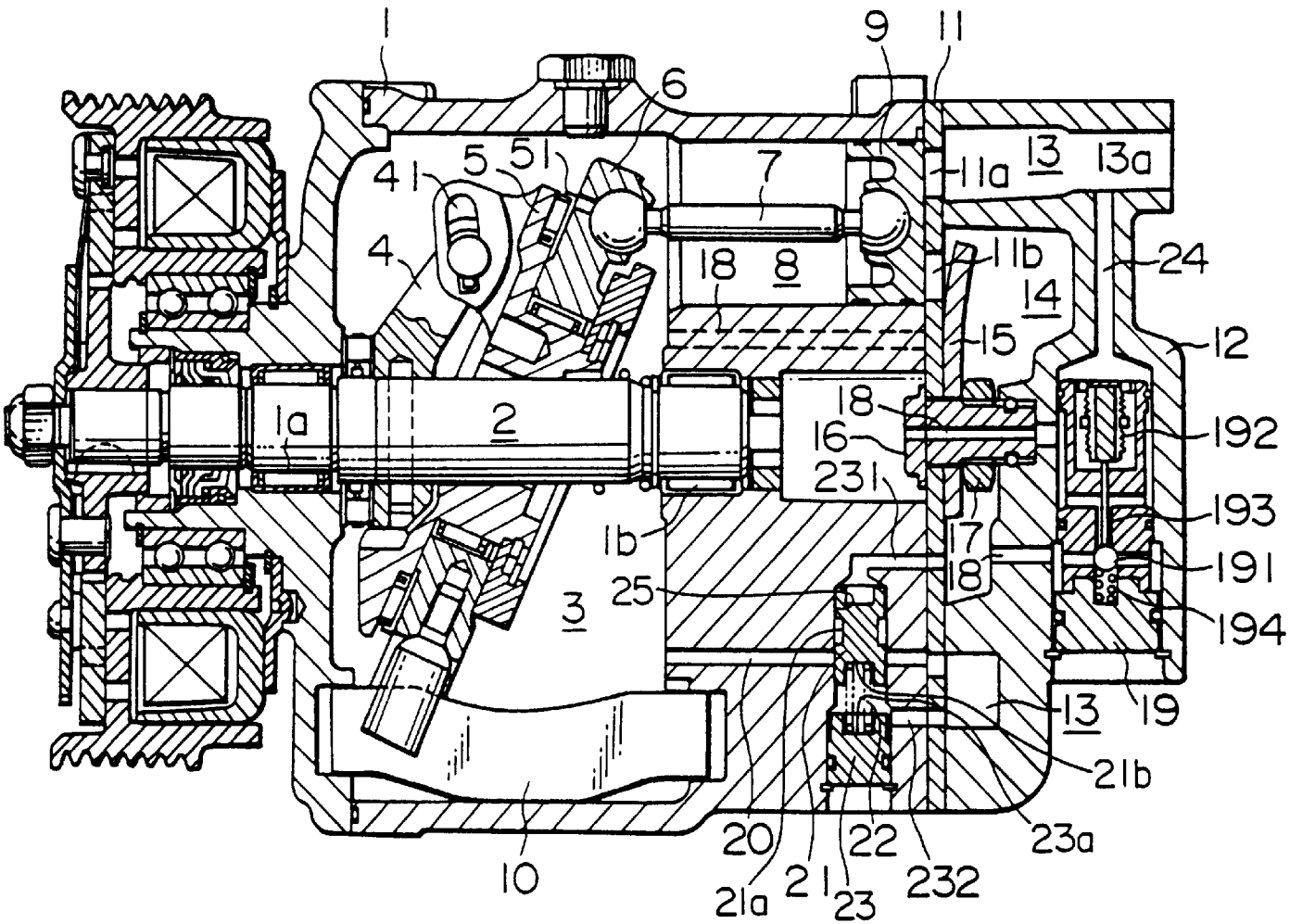
FIG. 1 is a sectional view showing a variable displacement compressor according to a first preferred embodiment of the present invention.

Referring now to FIG. 1, a variable displacement compressor according to a first preferred embodiment of the present invention will be described.

The compressor is of a wobble plate type known in the art and is for a fluid such as a refrigerant. The compressor comprises a compressor casing 1 having a through hole at the center thereof. A main shaft 2 is inserted into this through hole and rotatably supported by the casing 1 via bearings 1*a* and 1*b*.

The casing 1 defines therein a crank chamber 3 wherein a rotor 4 is mounted on the main shaft 2. A swash plate 5 is coupled to the rotor 4 via a hinge mechanism 41. The main shaft 2 passes through the swash plate 5 such that the swash plate 5 abuts the main shaft 2 at an inner periphery thereof so as to be slidable relative to the main shaft 2. The swash plate 5 has an inclination relative to the main shaft 2. In the manner known in the art, the inclination of the swash plate 5 can be changed boy means of the hinge mechanism 41.

A wobble plate 6 is attached to the swash plate 5 via a bearing 51. A plurality of piston rods 7 are coupled to the wobble plate 6 through ball connection. The casing 1 is formed with a plurality of cylinders 8 which are arranged at regular angular intervals so as to surround the main shaft 2. Each of the piston rods 7 is coupled through ball connection to corresponding one of pistons 9 disposed in the respective cylinders 8.

In the crank chamber 3, a guide rod 10 is supported by the casing 1 so as to extend in parallel to the main shaft 2. The guide rod 10 is sandwiched by an end portion of the wobble plate 6 so that the end portion of the wobble plate 6 is wobbling relative to the guide rod 10 in an axial direction of the main shaft 2.

To a right end surface in the figure of the casing 1, a cylinder head 12 is attached via a valve plate 11 interposed therebetween, so as to close a right-side open end of the casing 1. A combination of the casing 1 and the cylinder head 12 is referred to as a compressor housing. The cylinder head 12 is formed with a suction chamber 13 and a discharge chamber 14. The suction chamber 13 communicates with a suction port 13*a*, while the discharge chamber 14 communicates with a discharge port (not shown). The valve plate 11 is formed with suction holes 11*a* and discharge holes 11*b*. The suction chamber 13 and the discharge chamber 14 communicate with the cylinders 8 via the suction holes 11*a* and the discharge holes 11*b*, respectively.

At the center of the valve plate 11, a suction valve (not shown), a discharge valve (not shown) and a valve retainer 15 are fixedly mounted by means of a bolt 16 and a nut 17.

The bolt 16 and the cylinder head 12 are formed with a first communication passage 18 for establishing communication between the discharge chamber 14 and the crank chamber 3. As shown in the figure, a pressure control valve 19 is disposed in the communication passage 18. When the pressure control valve 19 is opened, the discharge chamber 14 and the crank chamber 3 communicate with each other.

The casing 1 is formed with a second communication passage 20 which extends in the axial direction and is for establishing communication between the crank chamber 3 and the suction chamber 13. The casing 1 is further formed with a cylinder 25 which extends to intersect the second communication passage 20.

As shown in the figure, a valve member 21 is disposed in the cylinder 25. The valve member 21 is closely fitted into the cylinder 25 to be slidable along the cylinder 25 and has a circular groove 21*a* on a peripheral surface thereof. In addition, a plug 25 is snugly fitted into the cylinder 25 to close an opening of the cylinder 25. The valve member 21 and the plug 25 have recessed portions 21*b* and 23*a*, respectively, opposite to each other. A compression spring 22 is interposed between the recessed portions 21*b* and 23*a*.

With this structure, the valve member 21 is movable between a first position for closing the communication passage 20 by the peripheral surface thereof and a second position for opening the communication passage 20 through the circular groove 21. The valve member 21 is biased by a spring 22 towards the first direction to close the communication passage 20.

A pressure in the discharge chamber 14 is applied to an upper side of the valve member 21 in the figure via a communication passage 231 connected between the discharge chamber 14 and the cylinder 25, while a pressure in the suction chamber 13 is applied to a lower side of the valve member 21 via a communication passage 232 connected between the suction chamber 13 and the cylinder 25. Accordingly, the valve member 21 is operated in response to a pressure differential between the discharge chamber 14 and the suction chamber 13. In this embodiment, a set load of the spring 22 is adjusted so that the valve member 21 fully closes the communication passage 20 in response to a pressure differential smaller than a pressure differential between the discharge chamber 14 and the suction chamber 13 which is obtained at the minimum discharge displacement of the compressor. Specifically, when a pressure differential between the discharge chamber 14 and the suction chamber 13 is not greater than a predetermined value, the communication passage 20 is fully closed to prevent communication between the crank chamber 3 and the suction chamber 13. The spring 22 will be referred to as a setting arrangement which is for setting, as the set load, a predetermined value of pressure differential. The communication passages 231 and 232 serve as a first and a second pressure transmission passage, respectively. A combination of the communication passages 231 and 232 will be referred to as a valve driving arrangement.

Now, a structure of the pressure control valve 19 will be described.

Figure 2:
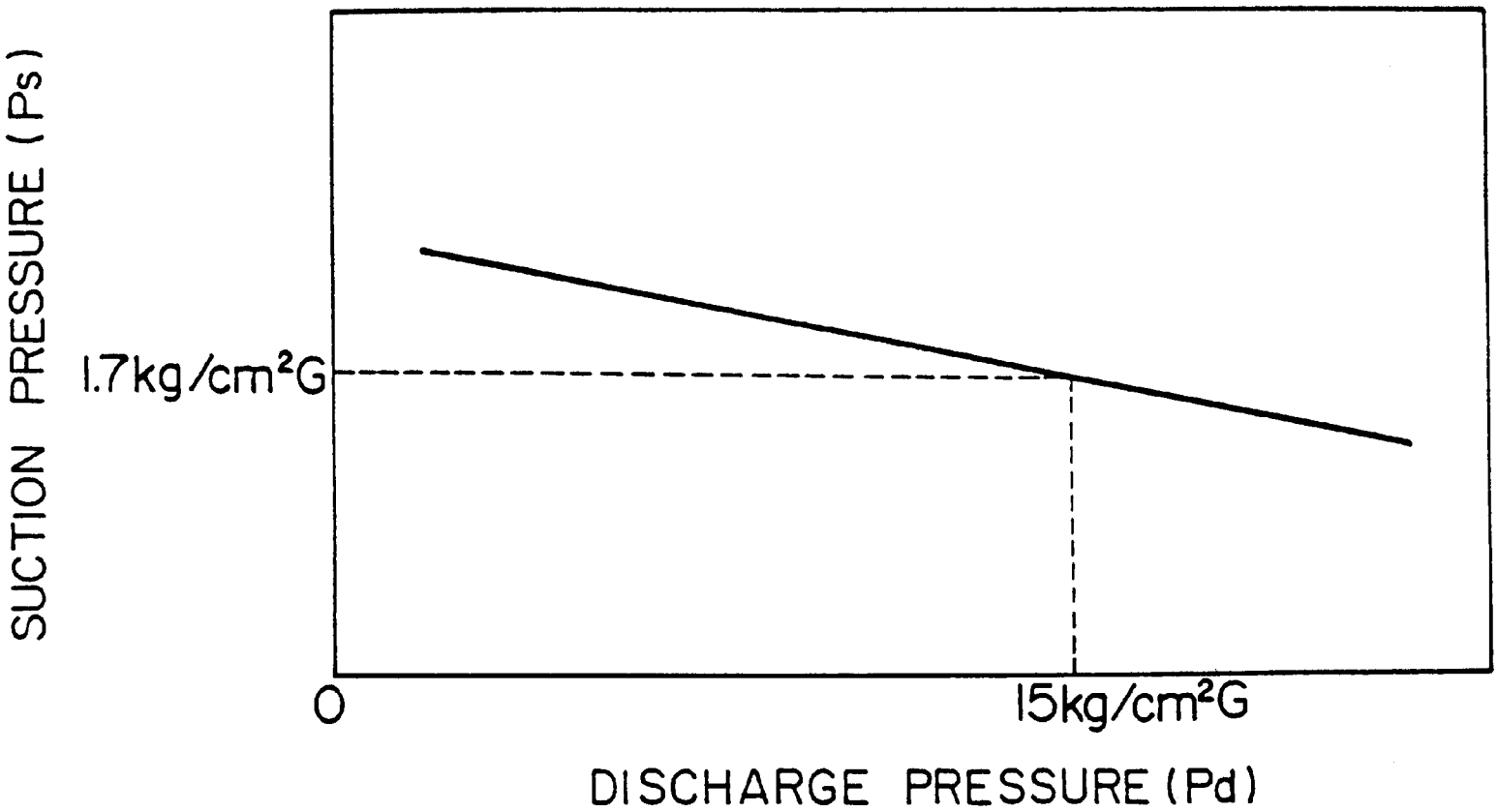
FIG. 2 is a diagram showing a pressure control characteristic of a pressure control valve shown in FIG. 1.

The pressure control valve 19 is provided with a valve member 191 for opening and closing the communication passage 18, and further provided with a bellows 192. The inside of the bellows 192 is under vacuum and provided with a spring. The bellows 192 is sensitive to a pressure in the suction chamber 13 via a communication passage 24. A transfer rod 193 is attached to the bellows 192 and operates the valve member 191 in response to expansion and contraction of the bellows 192 so as to open and close the communication passage 18. As seen from the figure, the valve member 191 is biased by a spring 194 in a direction to close the communication passage 18. Accordingly, the pressure control valve 19 carries out an open/close control of the valve member 191 in response to the pressure in the suction chamber 13 monitored by the bellows 192. The pressure control valve 19 has a pressure control characteristic as shown, for example, in FIG. 2, wherein a suction pressure (Ps) linearly decreases as a discharge pressure (Pd) increases. In the pressure control characteristic shown in FIG. 2, when the discharge pressure is 15 kg/cm$^2$G, the suction pressure becomes 1.7 kg/cm$^2$G. The spring 194 serves as a determining arrangement which is for determining a set pressure.

Now, an operation of the variable displacement compressor shown in FIG. 1 will be described.

In the state wherein the compressor is stopped, the pressures in the refrigeration circuit are balanced. For example, given that a balance pressure is 6 kg/cm$^2$G, since the balance pressure is higher than the pressure control characteristic shown in FIG. 2, the bellows 192 is contracted so that the valve member 191 closes the communication passage 18. On the other hand, since the pressures are balanced, the communication passage 20 is blocked by the valve member 21. In this event, the valve member 21 is positioned at the first position. The valve member 191 is referred to as a first valve. The valve member 21 is referred to as a second valve.

Therefore, while the compressor is stopped, the flow of the refrigerant into the crank chamber 3 is prohibited. Specifically, the refrigerant is prevented from flowing into the crank chamber 3 from the discharge chamber 14 and the suction chamber 13 via the communication passage 18 and the communication passage 20, respectively.

Figure 3:
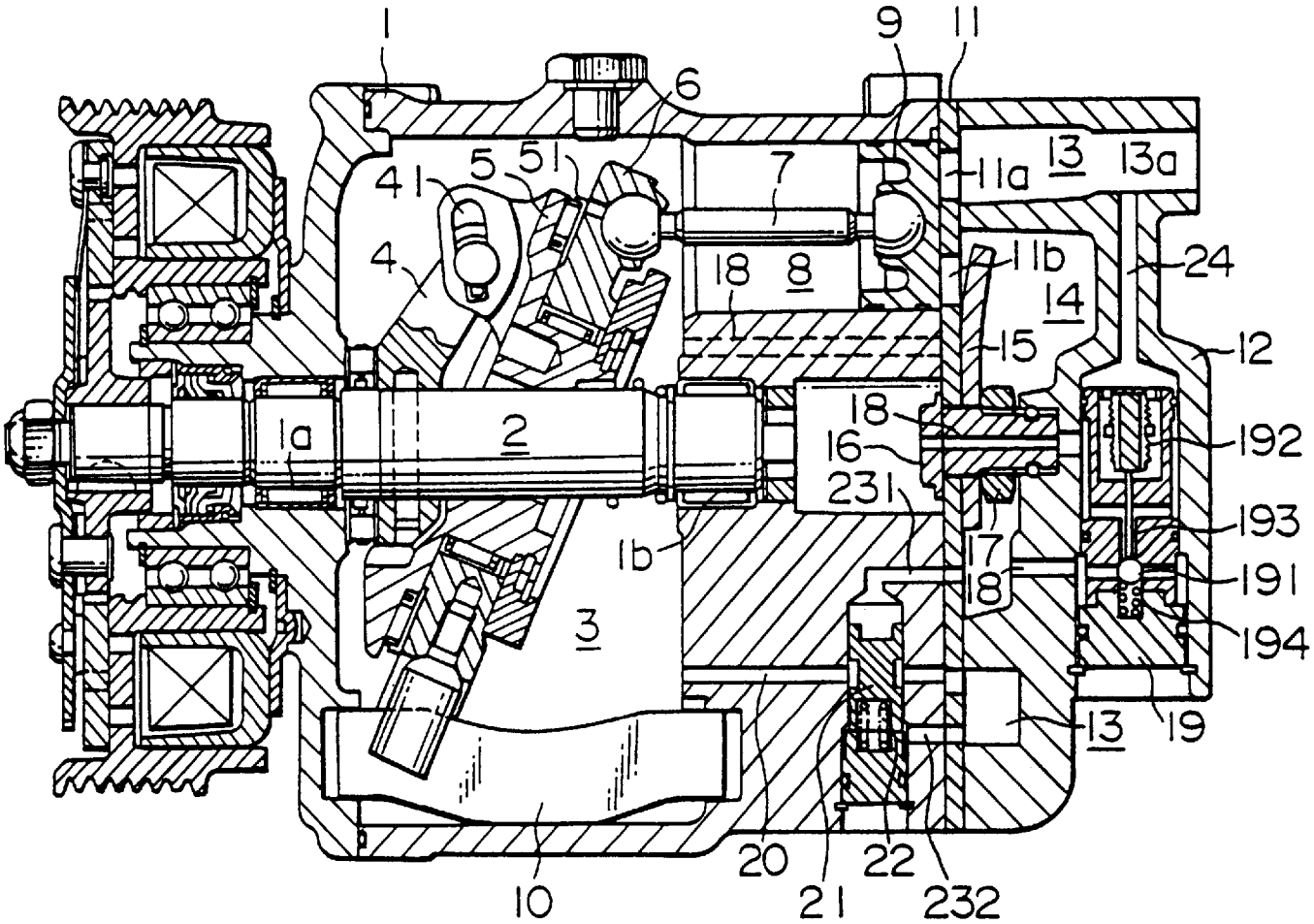
FIG. 3 is a sectional view showing the state wherein a valve member is opened in the compressor shown in FIG. 1.

If the compressor is started from the foregoing state, since the pressure control valve 19 is closed, the discharge gas does not flow into the crank chamber 3 so that the gas in the crank chamber 3 is only blowby gas introduced upon compression of the gas by the pistons 9. Since the compressor has the non-zero minimum compression displacement, the pressure in the suction chamber 13 is reduced. When a pressure differential between the discharge chamber 3 and the suction chamber 13 reaches a given value, the valve member 21 moves downward with a compression of the spring 22 to make the circular groove 21*a* correspond to the communication passage 20 (see FIG. 3). Concurrently, the communication passage 20 is opened via the insulator grooves 21*a* so that the gas in the crank chamber 3 flows into the suction chamber 13 through the communication passage 20 and the circular groove 21*a*. In this event, the valve member 21 is positioned at the second position.

As described above, since the gas in the crank chamber 3 is only the blowby gas, the amount of the gas flowing into the suction chamber 13 via the communication passage 20 is small so that a pressure differential between the crank chamber 3 and the suction chamber 13 floes not increase to a level which changes the inclination of the swash plate 5. Therefore, the inclination of the swash plate 5 becomes maximum to operate the compressor at the maximum piston stroke.

When the pressure in the suction chamber 13 reaches a given value or the set pressure (for example, 1.7 kg/cm$^2$G in FIG. 2), the bellows 192 expands so that the transfer rod 193 pushes down the valve member 191 to open the communication passage 18. Thus, a large amount of the discharge gas flows into the crank chamber 3. However, since a large amount of the gas in the crank chamber 3 can not escape into the suction chamber 13 via the communication passage 20, the pressure in the crank chamber 3 increases. Specifically, a pressure differential between the crank chamber 3 and the suction chamber 13 increases to diminish the inclination of the swash plate 5, thereby to reduce the piston stroke.

Following the reduction in piston stroke, the pressure in the suction chamber 13 starts to increase. Then, the bellows 192 is contracted to operate the valve member 191 in a direction to close the communication passage 18. Hence, the introduction amount of the discharge gas from the discharge chamber 14 into the crank chamber 3 is reduced so that a pressure differential between the crank chamber 3 and the suction chamber 13 is diminished to increase the inclination of the swash plate 5. This enlarges the piston stroke.

In the foregoing fashion, the opening degree of the valve member 191 is controlled to converge the pressure in the suction chamber 13 to the set pressure, thereby to control the discharge displacement of the compressor.

The pressure control valve 19 shown in FIG. 1 is of a so-called internal control type. On the other hand, as shown in FIG. 4, a pressure control valve which is operated by an external signal may be used instead of it.

Figure 4:
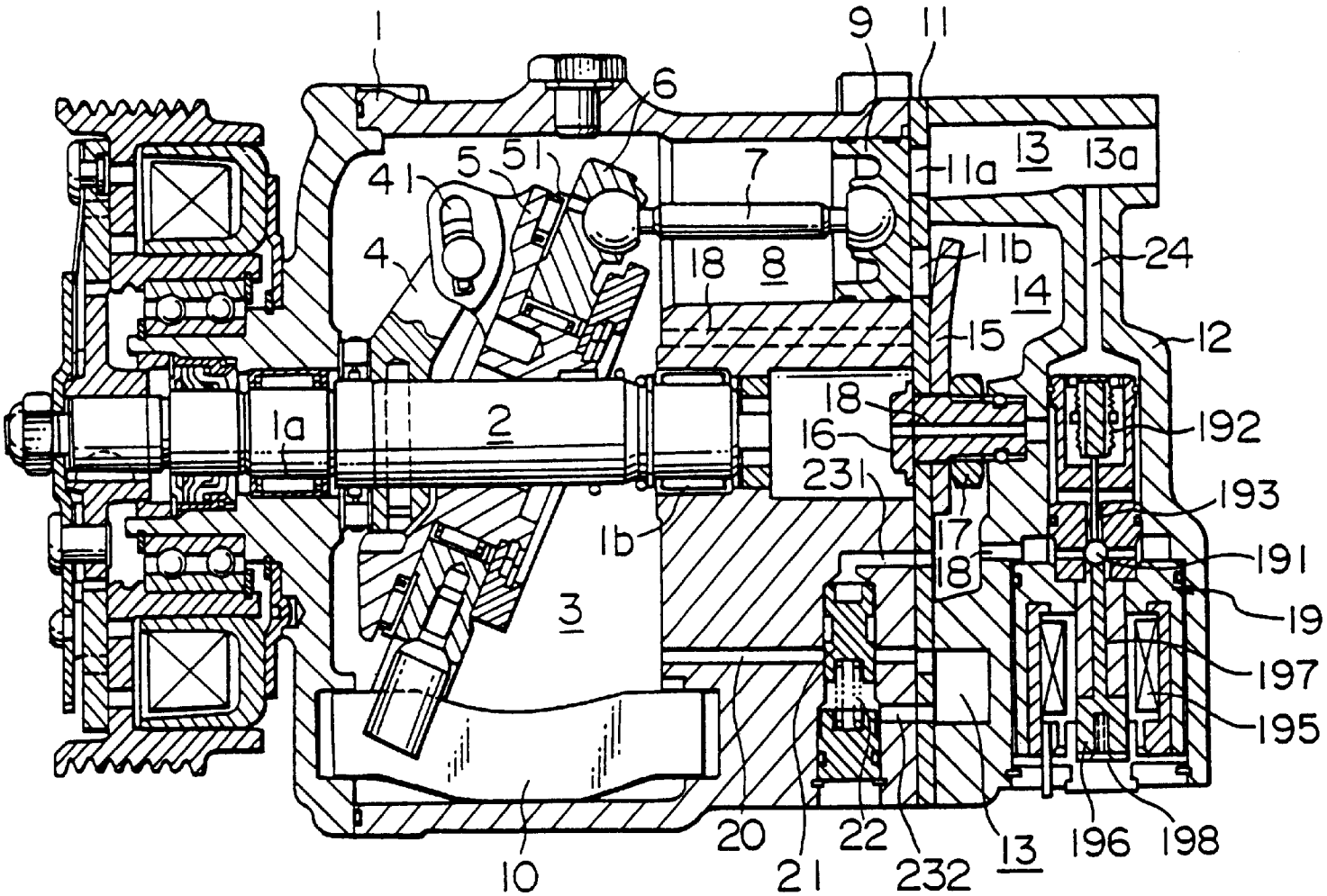
FIG. 4 is a sectional view showing a variable displacement compressor according to a second preferred embodiment of the present invention.

FIG. 4 shows a variable displacement compressor according to a second preferred embodiment of the present invention. The second preferred embodiment differs from the foregoing first preferred embodiment only in structure of the pressure control valve. Accordingly, the following explanation will be given only to the structure of the pressure control valve.

Referring to FIG. 4, as in the first preferred embodiment, the shown pressure control valve 13 is provided with a valve member 191 for opening and closing the communication passage 18, and further provided with a bellows 192. The inside of the bellows 192 is under vacuum and provided with a spring. The bellows 192 is sensitive to a pressure in the suction chamber 13 via the communication passage 24. A transfer rod 193 is attached to the bellows 192 and operates the valve member 191 in response to expansion and contraction of the bellows 192 so as to open and close the communication passage 18.

In this embodiment, the pressure control valve 19 is further provided with an electromagnetic coil 195 confronting the bellows 192, and a plunger 196 surrounded by the electromagnetic coil 195. The plunger 196 is slidable relative to the electromagnetic coil 195 and fixed with a transfer rod 197 at its tip. The plunger 196 is provided with a spring 198 so that the transfer rod 197 presses the valve member 191 in a closing direction depending on an electromagnetic force of the electromagnetic coil 195 and a biasing force of the spring 198. A combination of the electromagnetic coil 194 and the plunger 196 will be referred to as a force generating arrangement which is for generating electromagnetic force to urge the valve member 191 against the pressure of the suction chamber 13. The force generating arrangement will also be referred to as the determining arrangement.

Specifically, the pressure control valve 19 carries out an open/close control of the valve member 191 in response to the pressure in the suction chamber 13 monitored by the bellows 192. In this event, the set pressure changes depending on an amount of current supplied to the electromagnetic coil 195.

According to each of the foregoing preferred embodiments, the communication between the crank chamber 3 and the suction chamber 13 is prohibited in response to a pressure differential smaller than a pressure differential between the discharge chamber 14 and the suction chamber 13 obtained at the minimum discharge displacement of the compressor. Therefore, the refrigerant can be prevented from flowing into the crank chamber 3 from the suction chamber 13 via the communication passage 20 in the state of the compressor being stopped so that the maximum compression displacement can be smoothly achieved upon the start-up of the compressor.

While the present invention has thus far been described in conjunction with a few preferred embodiments thereof, it will readily be possible for those skilled in the art to put this invention into practice in various other manners. For example, the present invention is also applicable to a variable displacement compressor of a single swash plate type known in the art.

What is claimed is:

1. A compressor for a fluid, comprising:

a compressor housing defining therein a crank chamber, a discharge chamber, and a suction chamber;

a main shaft rotatably supported to said compressor housing;

a swash plate disposed in said crank chamber and held to said main shaft to rotate together with said main shaft, said swash plate having an inclination variable relative to said main shaft;

a piston responsive to a rotation of said swash plate for moving said fluid from said suction chamber to said discharge chamber with a variable displacement dependent on said inclination, said piston controlling said inclination in response to a first pressure differential between said crank chamber and said suction chamber;

a first communication passage connected between said discharge chamber and said crank chamber for permitting said fluid to move between said discharge chamber and said crank chamber through said first communication passage;

a first valve coupled to said first communication passage for controlling the movement of said fluid through said first communication passage;

a second communication passage connected between said crank chamber and said suction chamber for permitting said fluid to move between said crank chamber and said suction chamber through said second communication passage; and a second valve coupled to said second communication passage for controlling the movement of said fluid through said second communication passage.

2. A compressor as claimed in claim 1, further comprising valve driving means coupled to said discharge chamber, said suction chamber, and said second valve for driving said second valve in response to a second pressure differential between said discharge chamber and said suction chamber.

3. A compressor as claimed in claim 2, further comprising setting means for setting a predetermine value of pressure differential, said second valve being connected to said setting means and fully closing said second communication passage when said second pressure differential is not greater than said predetermined value.

4. A compressor as claimed in claim 3, wherein said second valve opens said second communication passage when said second pressure differential is greater than said predetermined value.

5. A compressor as claimed in claim 3, wherein said predetermined value is set to be smaller than said second pressure differential that is obtained when said variable displacement is minimum.

6. A compressor as claimed in claim 2, wherein said second valve is movable between a first position for closing said second communication passage and a second position for opening said second communication passage, said valve driving means comprising:

a first pressure transmission passage connected to said discharge chamber for transmitting a pressure of said discharge chamber to said second valve to urge said second valve towards said second position;

a second pressure transmission passage connected to said suction chamber for transmitting a pressure of said suction chamber to said second valve to urge said second valve towards said first position; and a spring connected to said second valve for urging said second valve towards said first position.

7. A compressor as claimed in claim 1, wherein said first valve is operable at a set pressure in response to a pressure of said suction chamber to open said first communication passage.

8. A compressor as claimed in claim 7, further comprising determining means connected to said first valve for determining said set pressure.

9. A compressor as claimed in claim 8, wherein said determining means comprises a spring which urges said first valve against said pressure of the suction chamber.

10. A compressor as claimed in claim 8, wherein said determining means comprises force generating means for generating electromagnetic force to urge said first valve against said pressure of the suction chamber.

11. A variable displacement compressor including a compressor housing defining therein a crank chamber, a discharge chamber, and a suction chamber, and including a swash plate disposed in said crank chamber and having a variable inclination relative to a main shaft, said swash plate being rotated in response to rotation of said main shaft to cause pistons to make reciprocating motions, the inclination of said swash plate being changed depending on a pressure differential between said crank chamber and said suction chamber to change a piston stroke so as to control a discharge displacement of the compressor, said compressor further comprising:

a first communication passage for establishing communication between said discharge chamber and said crank chamber;

a valve coupled to said first communication passage for opening and closing said first communication passage to control a pressure in said crank chamber;

a second communication passage for establishing communication between said crank chamber and said suction chamber; and a valve coupled to said second communication passage for fully closing said second communication passage when a pressure differential between said discharge chamber and said suction chamber becomes not greater than a predetermined value.

12. A variable displacement compressor as claimed in claim 11, wherein said predetermined value is set to be smaller than a pressure differential between said discharge chamber and said suction chamber which is obtained when said discharge displacement is minimum.

* * * * *